United States Patent [19]

Murata et al.

[11] Patent Number: 4,834,298

[45] Date of Patent: May 30, 1989

[54] CRUSHING METHOD AND APPARATUS

[75] Inventors: Hiroyuki Murata, Kobe; Masahiro Chiji, Akashi; Takeshi Tanaka, Kure; Tadao Kuwahara, Kure; Harunaga Kiuchi, Kure; Masamichi Cho, Kure, all of Japan

[73] Assignee: Kabushiki Kaisha Kobe Seiko Sho, Kobe, Japan

[21] Appl. No.: 96,454

[22] Filed: Sep. 15, 1987

[51] Int. Cl.[4] ..... B02C 23/02; B02C 23/08

[52] U.S. Cl. ..... 241/5; 241/24; 241/275

[58] Field of Search ..... 241/275, 300, 5, 24, 241/30

[56] References Cited

U.S. PATENT DOCUMENTS

| | | | |
|---|---|---|---|
| 3,174,697 | 3/1965 | Bridgewater | 241/275 |
| 3,186,650 | 6/1965 | Dixon et al. | 241/300 X |
| 3,346,203 | 10/1967 | Danyluke | 241/275 |
| 4,577,806 | 3/1986 | Terrenzio | 241/275 |
| 4,586,663 | 5/1986 | Bartley | 241/300 X |

FOREIGN PATENT DOCUMENTS

| | | |
|---|---|---|
| 48627 | 11/1972 | Australia . |
| 32001 | 12/1977 | Australia . |
| 62510 | 9/1986 | Australia . |
| 187258 | 8/1983 | European Pat. Off. . |
| 101277 | 2/1984 | European Pat. Off. . |
| 53-33785 | 9/1978 | Japan . |
| 5873347 | 11/1981 | Japan . |
| 59-95945 | 6/1984 | Japan . |
| 6233554 | 6/1985 | Japan . |
| 62-14953 | 7/1985 | Japan . |
| 1439639 | 6/1976 | United Kingdom . |

*Primary Examiner*—Joseph M. Gorski

*Attorney, Agent, or Firm*—Oblon, Fisher, Spivak, McClelland & Maier

[57] ABSTRACT

A carbide tip is provided at a charge stock discharge opening of a rotor in a crushing apparatus. The dimension of the carbide tip in the inner circumferential direction of the rotor is set to ½ or more of a maximum particle size of the charge stock. Furthermore, another dimension of the carbide tip is set to ½–2 times the maximum particle size of the charge stock. A groove is formed at or near a bonded portion between the carbide tip and a base material of an end blade, so as to avoid stress concentration at the bonded portion.

10 Claims, 8 Drawing Sheets m : MASS OF CHARGE STOCK P
r' : RADIUS OF ROTOR

CRUSHING METHOD AND APPARATUS

BACKGROUND OF THE INVENTION

1. Field of the Invention

This invention relates to a crushing apparatus, and more particularly to an impact type crushing apparatus useful for crushing or grading (chamfering) a raw rough stone such as rock and ore to a desired particle size for the purpose of producing sand. This invention also relates to a crushing method using the above crushing apparatus.

2. Description of the Prior Art

A conventional impact type crushing apparatus is shown in FIGS. 6 to 8, which apparatus is disclosed in Japanese Patent Publication No. 53-33785, for example.

Referring to FIGS. 6 to 8, a rotor 1 is rotatably mounted through a bearing 2 on a vertical shaft. A central distributor 20 is provided at the center of the rotor 1, and each pair of blades 21, 22 and 25 is arranged inside the rotor 1 in such a manner as to be rotated about the central distributor 20. An end blade 24 having a carbide tip 24*a* is fixed to an end portion of each blade 25, so as to protect the end portion from wear.

The raw rough stone (which will be hereinafter referred to as a charge stock) is supplied from a charge stock supplying device 11 to the central distributor 20, and is then fed by a centrifugal force through the blades 21, 22 and 25 and the end blades 24 to a pair of outlets 19, from which the charge stock is discharged outside the rotor 1.

As shown in FIG. 6, the charge stock discharged is collided against a dead stock 15 (alternatively, a ring liner 16 shown by an alternate long and two short dashed line) formed as a colliding portion inside a housing 8 for accommodating the rotor 1.

In the type where the charge stock is brought into collision against the dead stock 15, the crushing apparatus is employed for grading the charge stock (or correcting a particle shape of the charge stock), while in the type where the charge stock is brought into collision against the ring liner 16, the crushing apparatus is employed for crushing the charge stock.

The blades 21, 22 and 25 in the impact type crushing apparatus are arranged somewhat curvedly in such a manner as to surround the central distributor 20 located at the center of the rotor 1. With this arrangement, the charge stock discharged is accumulated at such a curved portion to form a dead stock 17 until it reaches the end blade 24 through the blades 21, 22 and 25. As a result, an inner wall of the rotor 1 or a base material of the end blade 24 may be protected from wear because of the collision with the charge stock.

As shown in FIG. 8, two outlets 19 are formed at the circumference of the rotor 1, and two units of the blades 21, 22 and 25 as well as the end blade 24 are arranged about 180° apart along the circumference of the rotor 1.

However, the above-mentioned conventional impact type crushing apparatus has the following technical shortcomings.

(1) In the structure shown in FIG. 8 where the end blade 24 is protected by the dead stock 17, the smaller the particle size of the charge stock, the greater the effect of protection in relation with an angle of repose of the particle. However, the charge stock to be actually supplied to the rotor 1 is almost a relatively large particle having a diameter of 20–80 mm. Therefore, when the charge stock is accumulated as a dead stock, the surface of the accumulated charge stock is unstable.

As shown in FIG. 9, the dead stock 17 is repeatedly broken and formed at a local area as shown by a dotted line and an alternate long and two short dashed line. Accordingly, every time the dead stock 17 is broken, the base material of the end blade 24 is exposed at its end portion, and it is therefore worn by the collision with charge stock.

In another type end blade as disclosed in Japanese Utility Model Laid-Open Publication No. 58-73347, the carbide tip is a reversible type where both surfaces of the carbide tip on the center side and the outer circumference side of the rotor may be used, so as to increase life against wear. However, such does not protect the base material of the end blade from wear due to the fluctuation of the dead stock as mentioned above.

In a further of end blade as disclosed in Japanese Patent Laid-Open Publication No. 59-95945, the carbide tip 24*a* is mounted on a chambered portion of the end blade, and a collision surface of the carbide tip colliding with the charge stock is inclined at about 45 degrees with respect to the center side of the rotor. However, since this angle is greater than an angle of repose (about 40 degrees) of the charge stock (dead stock), a sufficient amount of dead stock is not formed at the end portion of the end blade. As shown by a hatched portion $B_1$ in FIG. 9, the base material of the end blade 24 is exposed to the charge stock because of the fluctuation of the dead stock 17, causing the generation of wear due to the collision of the charge stock with the base material.

As described above, the prior art impact type crushing apparatus includes the carbide tip mounted at the end portion of the end blade, so as to protect the end portion of the base material of the end blade from wearing due to the collision with the charge stock. However, the base material of the end blade tends to be exposed by the fluctuation of the dead stock, and wear of the base material exposed cannot be prevented.

As shown in FIG. 9, the unstable surface layer of the dead stock is fluctuated in a range of about ½ of the particle size r of the charge stock P (between the charge stocks $P_1$ and $P_2$). The particle size r is dependent upon a sieve opening size in a sieving step to be conducted prior to the crushing step.

(2) As shown in FIG. 9, the charge stock P shown by a solid line is rolled on the inclined surface of the dead stock 17 and is slid outwardly at the velocity v in the direction shown by an arrow A.

Referring to FIG. 10, as the rotor 1 is rotated at a fixed angular velocity $\omega$, a constant component (Coriolis' force) $2\,mv\omega$ is applied to the charge stock P rolling on the inclined surface of the dead stock 17. Referring back to FIG. 9, when the charge stock P reaches the carbide tip 24*a* of the end blade 24, a frictional force due to the Coriolis' force is generated between the side surface of the carbide tip 24*a* (end surface 24*b* of the end blade 24) and the charge stock.

Accordingly, in the end blade 24 having no hard material such as the carbide tip on the end surface 24*b* as disclosed in the aforementioned prior art, Japanese Patent Laid-Open Publication No. 59-95945, there is formed a large amount of friction as shown by a hatched portion $B_2$ in FIG. 9 at the end surface 24*b* by the charge stocks $P_3$ and $P_4$ having passed the carbide tip 24*a*.

Further, in the end blade as disclosed in the aforementioned prior art, Japanese Utility Model Laid-Open Publication No. 58-73347, a hard material is fixed on the entire end surface of the end blade so as to prevent the generation of friction shown by the hatched portion $B_2$ in FIG. 9. However, the dimension of the hard material in relation to a size (particle size) of the charge stock is not specified.

That is, the length of the surface of the carbide tip on which the charge stock is slid in the radial direction of the rotor must be set to a value such that the influence of the Coriolis' force is reduced to substantially zero, and the charge stock may be retained until the velocity of the charge stock in the radial direction of the rotor is accelerated. However, if the length is too large, the expensive carbide tip is increased in quantity, causing a reduction in economic efficiency.

(3) Particularly in order to solve the problem as mentioned in paragraph (1), it has been attempted to increase the dimension of the carbide tip in the circumferential direction of the rotor and thereby cover the range of the fluctuation of the unstable surface layer of the dead stock. However, the carbide tip is enlarged in size, and bending stress generated by the collision of the charge stock with a bonded portion between the carbide tip and the end blade is increased accordingly.

As a result, there is generated a concentration of stress increased in accordance with the increased size of the carbide tip at the bonded portion between the carbide tip and the end blade, causing damage to the carbide tip or separation thereof from the end blade.

SUMMARY OF THE INVENTION

It is an object of the present invention to provide a crushing method and a crushing apparatus which may eliminate wear of the base material of the end blade due to the fluctuation of the dead stock the thereby increase a life of the end blade and the carbide tip.

It is another object of the present invention to provide a crushing apparatus which may prevent the friction between the charge stock and end surface of the base material of the end blade in the radial direction of the rotor.

It is a further object of the present invention to provide a crushing apparatus which may avoid stress concentration at the bonded portion between the carbide tip and the end blade to thereby prevent separation of the carbide tip from the end blade.

According to a first aspect of the present invention, in a crushing method including the steps of (a) a sieving step for selecting a particle size of a charge stock to be crushed to a suitable size; (b) a charge stock supplying step for supplying to a rotor the charge stock sieved in the sieving step (a); and (c) a crushing step for accumulating the charge stock supplied to the rotor near a charge stock discharge opening of the rotor after the charge stock supplying step (b), discharging outwardly the charge stock from the charge stock discharge opening by a centrifugal force, and bringing the charge stock into collision against a collision surface formed around the rotor; the improvement is characterized in that a carbide tip is provided at an end portion of the charge stock discharge opening of the rotor, and a length dimension of an inside or radially inner surface of the carbide tip on a center side of the rotor is set to ½ or more of a sieve opening size allowing the pass of the charge stock in the sieving step (a).

According to a second aspect of the present invention, in a crushing apparatus including a sieving machine for selecting a charge stock to be crushed, a rotor adapted to be rotated at high speeds, the rotor being provided with a charge stock discharge opening for discharging outwardly the charge stock fed into the rotor from the charge stock discharge opening by a centrifugal force, and a collision surface provided around the rotor, wherein the charge stock discharged from the charge stock discharge opening collides with the collision surface, and is thereby crushed; the improvement comprises a carbide tip provided at an end portion of the charge stock discharge opening of the rotor, wherein a length dimension of an inside or radially inner surface of the carbide tip on a center side of the rotor is set to ½ or more of a predetermined maximum particle size of the charge stock passing through the sieving machine.

The length dimension of the inside or radially inner surface of the carbide tip on the inner radial center side of the rotor is set to ½ or more of the sieve opening size in the sieving step. On the other hand, the unstable surface layer of the dead stock formed at the end portion of the charge stock formed at the end portion of the charge stock discharge opening is fluctuated over a width of about ½ of the particle size of the charge stock passing through the sieve opening in the sieving step. Accordingly, the width of the unstable surface layer of the dead stock is equal to the width of the carbide tip, and it is possible to prevent wear of the end blade due to the fluctuation of the unstable surface layer of the dead stock.

According to a third aspect of the present invention, in a crushing apparatus including a sieving machine for selecting a charge stock to be crushed, a rotor adapted to be rotated at high speeds, the rotor being provided with a charge stock discharge opening for discharging outwardly the charge stock fed into the rotor from the charge stock discharge opening by a centrifugal force, and a collision surface provided around the rotor, wherein the charge stock discharged from the charge stock discharge opening collides with the collision surface, and is thereby crushed; the improvement comprises a carbide tip provided at an end portion of the charge stock discharge opening of the rotor, wherein a length dimension of a radial surface of the carbide tip extending in a radial direction of the rotor is set to ½–2 times a predetermined maximum particle size of the charge stock passing through the sieving machine.

When the charge stock passes through the end surface of the base material of the end blade in the radial direction of the rotor, the Coriolis' force is received by the carbide tip. As the length dimension of the carbide tip in the radial direction of the rotor is a distance (½–2 times maximum particle size of the charge stock) allowing the acceleration enough to almost eliminate the Coriolis' force, a maximum effect may be economically obtained with a minimum carbide tip.

According to a fourth aspect of the present invention, in a crushing apparatus including a sieving machine for selecting a charge stock to be crushed, a rotor adapted to be rotated at high speeds, the rotor being provided with a charge stock discharge opening for discharging outwardly the charge stock fed into the rotor from the charge stock discharge opening by a centrifugal force, and a collision surface provided around the rotor, wherein the charge stock discharged from the charge stock discharge opening collides with the collision surface, and is thereby crushed; the improvement comprises a carbide tip provided at an end portion of the charge stock discharge opening of the rotor, and a base material bonded to the carbide tip, the base material being formed with a groove extending along a bonded portion between the base material and the carbide tip at or near the bonded portion.

Since the stress tending to be concentrated at or near the bonded portion between the carbide tip and the base material is directed to the groove formed at or near the bonded portion, and is diffused at the groove, stress concentration at the bonded portion may be avoided.

Other objects and features of the invention will be more fully understood from the following detailed description and appended claims when taken with the accompanying drawings.

BRIEF DESCRIPTION OF THE DRAWINGS

FIG. 11 is an illustration showing the relation of the forces generated at the colliding portion of the carbide tip which the charge stock collides with.

DESCRIPTION OF THE PREFERRED EMBODIMENTS

Figure 9:
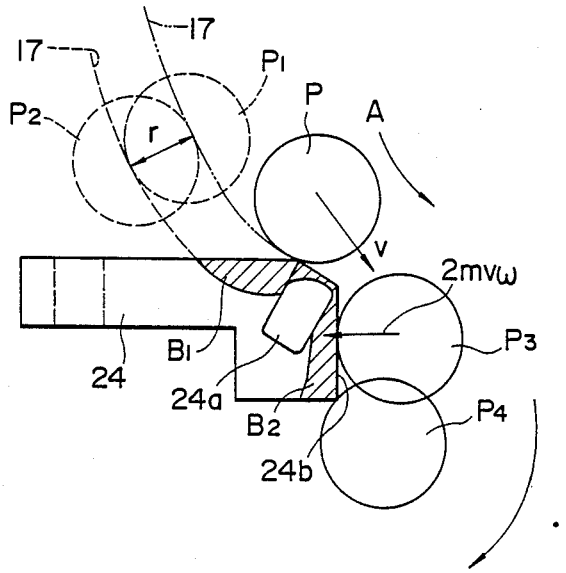
FIGURE 9 PRIOR ART
FIG. 9 is a schematic illustration of the dead stock formed at the end blade shown in FIG. 8.
Figure 10:
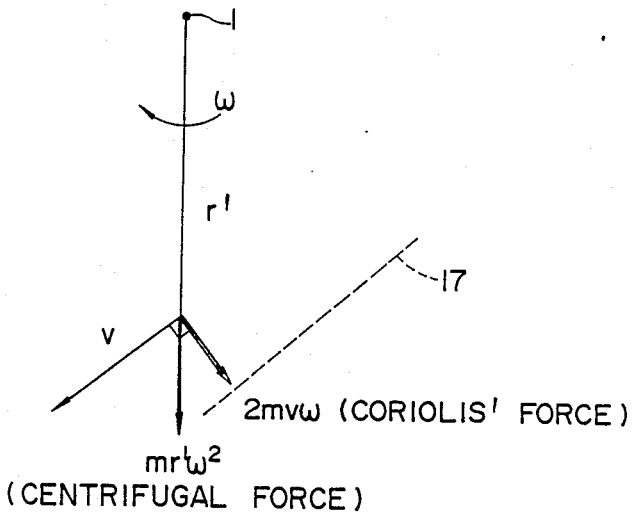
FIGURE 10 PRIOR ART
FIG. 10 is a vector diagram of the forces acting on the charge stock P shown in FIG. 9.

There will now be described a preferred embodiment of the present invention, wherein the same parts as in FIG. 9 are designated by the same reference numerals.

Figure 1:
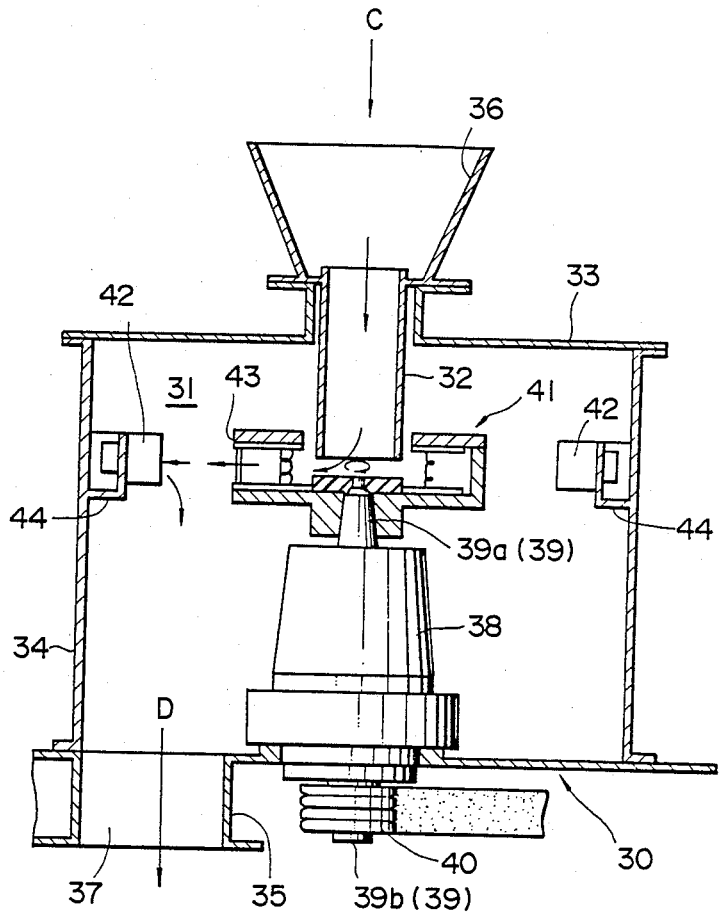
FIG. 1 is a schematic vertical sectional view of an impact type crushing apparatus in a preferred embodiment of the present invention.

Referring to FIG. 1, an impact type crushing apparatus 30 includes a base 35, a housing 34 mounted on the base 35, and a lid 33 mounted on the housing 34 to define a crushing chamber 31 in the hosing 34. The lid 33 is provided at its substantially central portion with a charge stock supplying portion 32 for supplying a charge stock to the crushing chamber 31 as shown by an arrow C. The charge stock supplying portion 32 is provided with a hopper 36. The base 35 is formed with a discharge opening 37 for discharging downwardly as shown by an arrow B the charge stock crushed in the crushing chamber 31.

A bearing box 38 is fixed on the upper surface of the base 35, and a rotor shaft 39 is arranged at a substantially central portion of the crushing chamber 31 in such a manner as to be rotatably and horizontally supported by the bearing box 38. A lower end portion 39*b* of the rotor shaft 39 is inserted through the base 35, and a V-pulley 40 to be driven by a driving device (not shown) arranged at a predetermined position is engaged with the lower end portion 39*b*.

An upper end portion 39*a* of the rotor shaft 39 is located at a substantially central position of the crushing chamber 31, and a hollow cylindrical rotor 41 is mounted to the upper end portion 39*a* in such a manner as to be horizontally rotated about the rotor shaft 39.

Brackets 44 are formed on the inner wall surface of the housing 34 at positions corresponding to the height of charge stock discharge openings 43 of the rotor 41, and a plurality of anvils 42 are mounted to the brackets 44 in such a manner that each charge stock collision surface thereof is opposed to the outer periphery of the rotor 41.

Figure 6:
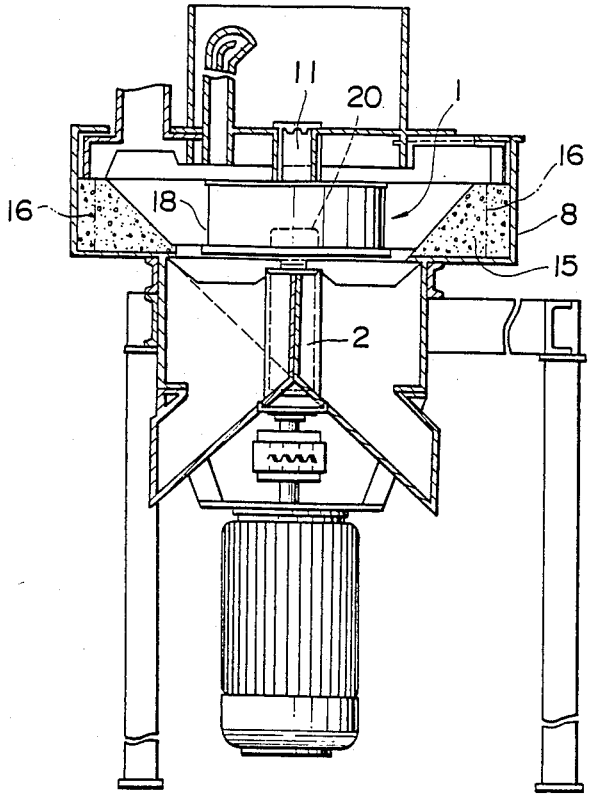
FIGURE 6 PRIOR ART
FIG. 6 is a schematic vertical sectional view of the conventional impact type crushing apparatus.
Figure 7:
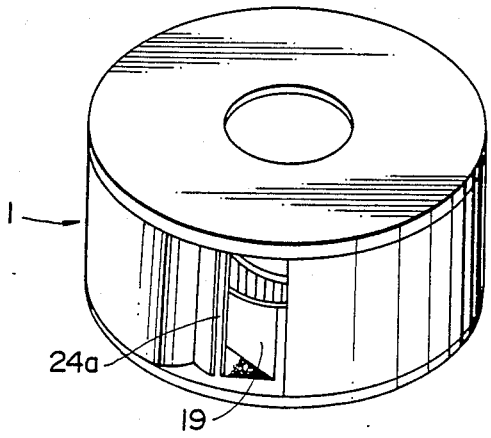
FIGURE 7 PRIOR ART
FIG. 7 is a general perspective view of the rotor shown in FIG. 6.
Figure 8:
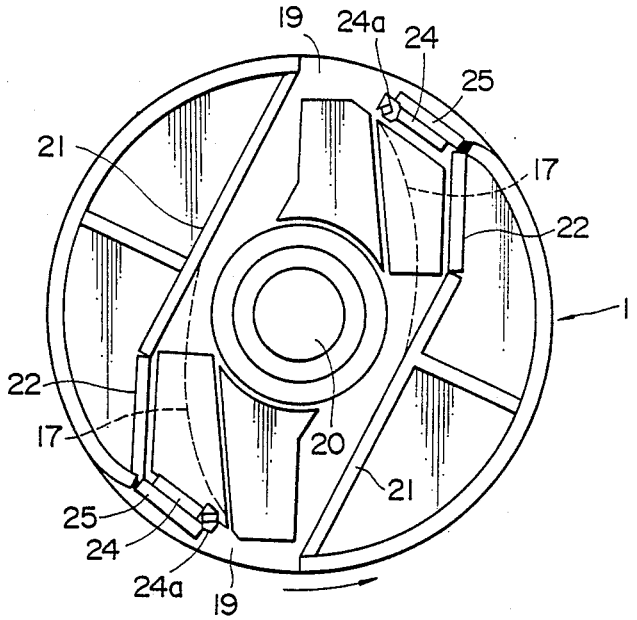
FIGURE 8 PRIOR ART
FIG. 8 is a plan view of an inside structure of the rotor shown in FIG. 6.

The rotor 41 has a function substantially the same as that of the rotor 1 shown in FIGS. 6 to 8. That is, the charge stock supplied to the rotor 41 is discharged therefrom by a centrifugal force.

Figure 2:
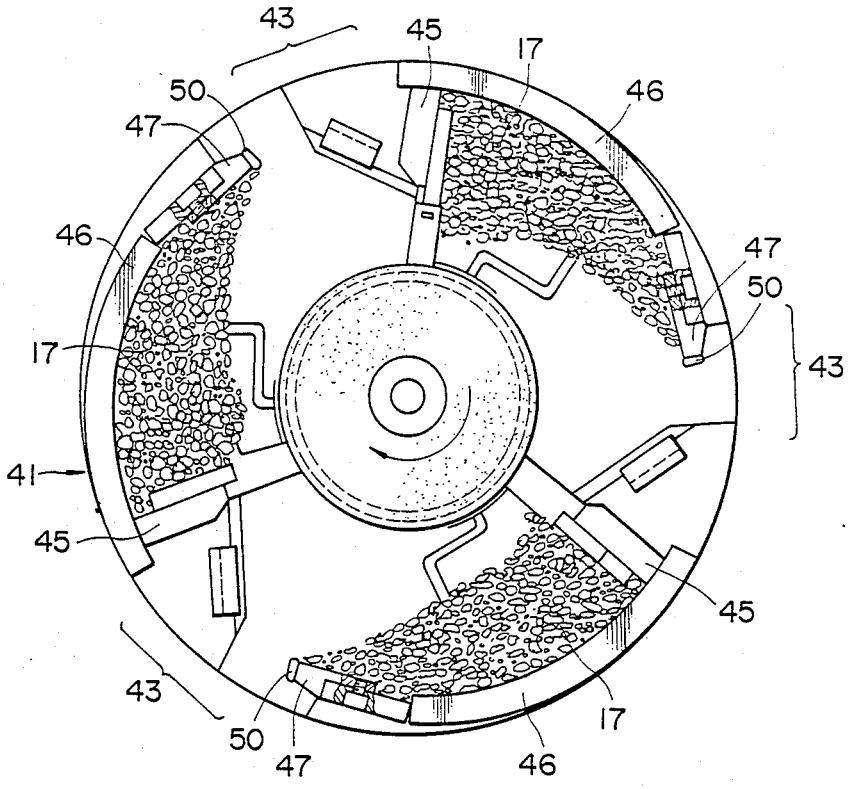
FIG. 2 is a plan view of the interior structure of a rotor shown in FIG. 1.

As shown in FIG. 2, the charge stock supplied to the central portion of the rotor 41 is accumulated inside the rotor 41 to form dead stocks 17 spaced at a suitable angle along the circumference of the rotor 41. The charge stock accumulated is discharged through the dead stocks 17 and the charge stock discharge openings formed on the circumferential side wall of the rotor 41 in association with the high-speed rotation of the rotor 41.

The rotor 41 is provided interiority with three partition boards 45 directed radially of the rotor 41, three arcuate side walls 46 extending along the inner circumference of the rotor 41, and three end blades 47, so as to form the dead stocks 17. The partition boards 45, the side walls 46 and the end blades 47 are arranged at angular intervals of about 120 degrees in the circumferential direction of the rotor 41.

As also shown in FIG. 2, a carbide tip 50 is fixed to the end of each end blade 47 so as to be exposed and protect the end of the end blade 47 from wearing created by collision with the charge stock in the same manner as in FIG. 8. In the present invention, the term of the carbide tip includes a hard metal tip and a cemented carbide tip.

Figure 3:
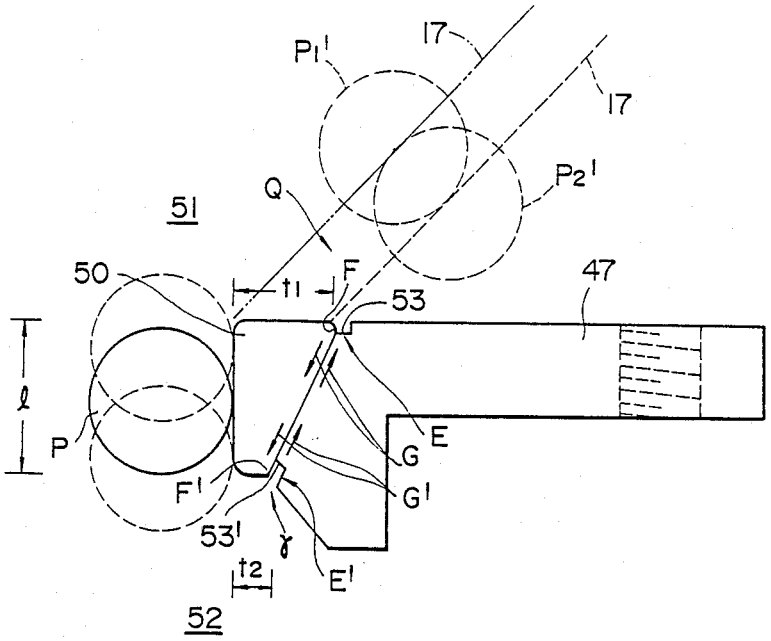
FIG. 3 is a side view of a carbide tip mounted to an end blade shown in FIG. 2.

Referring to FIG. 3, the carbide tip 50 has a surface opposed to a center or inner radial side 51 of the rotor 41. The dimension $t_1$ of the surface along the circumference of the rotor 41 is set to be $\frac{1}{2}$ or more of a sieve opening size in a sieving step to be conducted before a crushing step.

Figure 4:
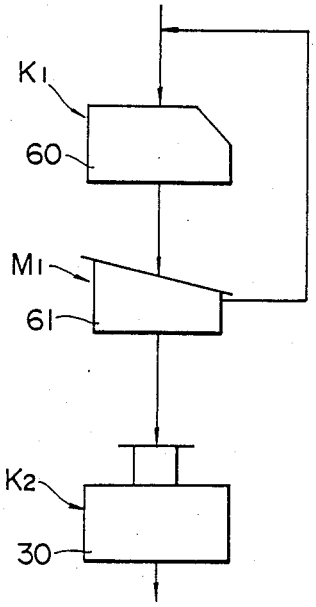
FIG. 4 is a flow diagram of a charge stock to be supplied to the impact type crushing apparatus shown in FIG. 1.
Figure 5A:
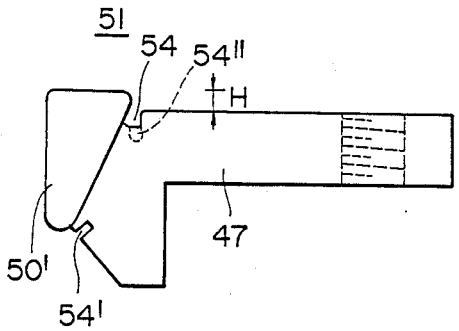
FIGS. 5*a* to 5*g* are various modifications of the carbide tip mounted to the end blade.
Figure 5B:
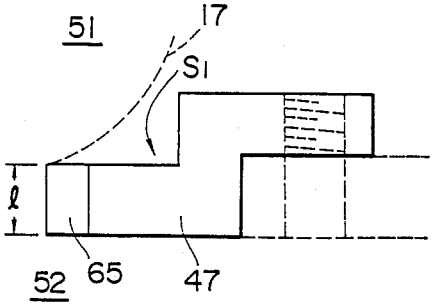
Figure 5E:
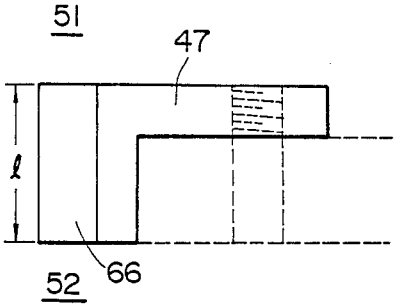
Figure 5C:
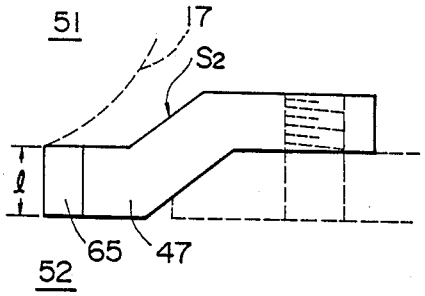
Figure 5F:
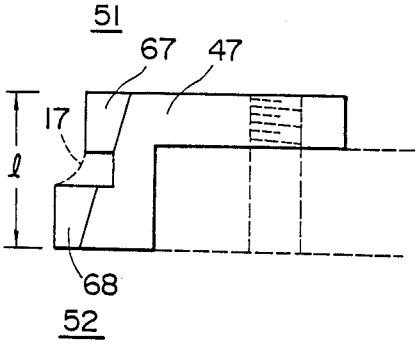
Figure 5D:
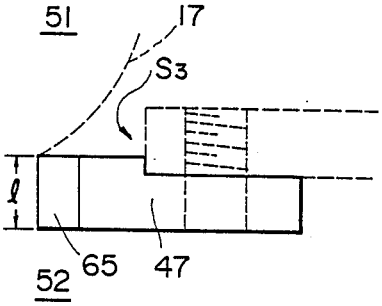
Figure 5G:
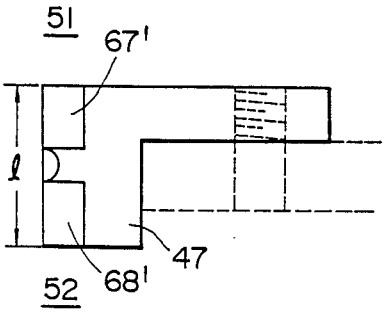

Referring to FIG. 4 which shows a preliminary step to be conducted before the crushing step, large-sized rough stones extracted are generally fed to a large-scale charge stock crushing machine 60 (i.e., jaw crusher) for conducting a primary crushing step $K_1$. In the primary crushing step $K_1$, the large-sized charge stock is crushed to obtain a particle size required by a secondary crushing step $K_2$ to be provided downstream of the primary crushing step $K_1$ in a flow direction of the charge stock as shown by an arrow in FIG. 4. An example of the crushing machine for conducting the secondary crushing step $K_2$ is an apparatus shown in FIG. 1, that is, the impact type crushing apparatus 30.

There is provided between the primary crushing step $K_1$ and the secondary crushing step $K_2$ a sieving step $M_1$ for sieving the charge stock into a particle size required by the secondary crushing step $K_2$. The sieving step $M_1$ is generally conducted by a vibration sieving machine 61. The vibration sieving machine 61 is provided with a screen having a sieve opening size corresponding to the particle size required by the secondary crushing step $K_2$ so as to drop the charge stock having such particle size down to the secondary crushing step $K_2$.

The charge stock having a particle size larger than the above particle size is left in the vibration sieving machine 61, and is fed back to the upstream side of the primary crushing step $K_1$. Then, the above crushing process is repeated until the particle size of the charge stock reaches a size allowed to pass through the screen of the vibration sieving machine 61.

Thus, the impact type crushing apparatus 30 is sequentially supplied with the charge stock having a predetermined particle size dependent upon the sieve opening size of the vibration sieving machine 61 in the sieving step $M_1$.

As shown in FIG. 3, an unstable layer portion Q (an area defined between an alternate long and two short dashes line and a dotted line in FIG. 3) of the dead stock 17 is formed at the end blade 47 as shown in FIG. 2. The unstable layer portion Q is fluctuated in a width r equal to about ½ of the particle size (which width corresponds to a radius of the particle) of the charge stocks $P_1'$ and $P_2'$, etc. passing through the sieve opening of the vibration sieving machine 61 in the sieving step.

Accordingly, the unstable layer portion Q of the dead stock 17 lies within the range of the dimension $t_1$ of the carbide tip 50 in the circumferential direction of the rotor 41, and the end of the end blade 47 is not exposed. Thus, it is possible to prevent the wearing of a base material of the end blade 47 because of the fluctuation of the unstable layer portion Q of the dead stock 17.

Furthermore, as shown in FIG. 3, the carbide tip 50 has a dimension l set to ½ (±30%)–2 (±30%) times the particle size of the charge stock passing through the sieving machine 61 in the sieving step to be carried out before the secondary crushing step.

The above set range of the dimension l is proved from the following experimental results.

If the length dimension l denoting the distance between the inside edge 50*a* of the carbide tip 50 on the center side of the rotor and the outside or radially outer edge 50*b* on the outer circumference radial side of the rotor is ½ or less of the particle size of the charge stock, for example, the distance l is too short for the charge stock to be rolled between both the edges 50*a* and 50*b*. Referring to FIG. 9, before the charge stock P is given an acceleration in the radial direction of the rotor enough to reduce the Coriolis' force, the charge stock P is moved away from the carbide tip 50 to contact the base material of the end blade, causing the wearing of the base material.

In contrast, if the dimension l is twice or more the particle size of the charge stock P so as to obtain a sufficient acceleration of the charge stock P, the carbide tip is rendered large in size to reduce economic efficiency.

Accordingly, when the dimension l is set to ½–2 times the particle size of the charge stock P, the acceleration of the charge stock P is made sufficient to thereby sufficiently reduce a frictional force due to the Coriolis' force of the charge stock P to the carbide tip 50. Thereafter, the charge stock P is discharged from the carbide tip 50, thus preventing the undesired wear of the base material from occurring.

The carbide tip may be arranged at the outer circumference of the rotor or may be projected therefrom by extending the end blade as required. With this arrangement, it is possible to prevent the charge stock discharged from the end blade from colliding with the side wall of the rotor adjacent the end blade, thereby protecting the side wall of the rotor from wearing.

As the outside surface of the carbide tip 50 on the outer circumference side 52 of the rotor is worn less than the inside surface of the carbide tip 50 on the center or radially inner side 51 of the rotor, the dimension $t_2$ of the outside surface is set to be smaller than the dimension $t_1$ of the inside surface.

The dimension $t_2$ is selected to have a thickness (about 3 mm) sufficient enough to absorb a difference in thermal expansion upon brazing and protect the carbide tip from cracking in use. Accordingly, the carbide tip 50 is formed in a substantially tapered triangular shape, and the expensive material for the carbide tip 50 may be greatly reduced, thereby improving economic efficiency.

While the carbide tip 50 should be formed of high wear resistant materials, the angular portion and the edge portion of the carbide tip formed of such materials tend to be nicked or cracked by the collision with the charge stock.

Figure 11:
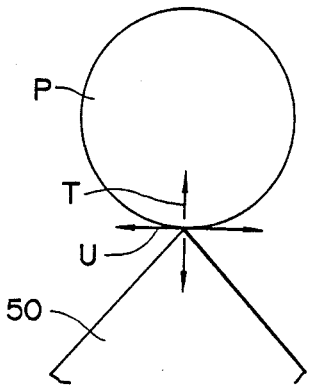

This is caused by the generation of two kinds of local stresses, that is, a compressive stress T and a tensile stress U between the carbide tip 50 and the charge stock P colliding with the angular portion of the carbide tip 50 as shown in FIG. 11.

Generally, the strength of the carbide tip 50 which is a brittle member against the tensile stress U is about ⅓ of the strength against the compressive stress T. Particularly, the more acute the colliding portion of the carbide tip, the greater the stress concentration which occurs. As a result, the colliding portion tends to be broken.

The magnitude of the tensile stress has a certain relationship with respect to both the size of the charge stock and the radius of curvature of the angular portion of the carbide tip. That is, the greater the size of the charge stock, or the smaller the radius of curvature of the angular portion of the carbide tip, the greater the magnitude of the tensile stress. Accordingly, it is preferable to preliminarily chamfer the angular portion of the tip and an end portion bonded to the end blade and round the chambered portion to 1R or more, for example, thus preventing nicking and cracking of the angular portion and the end portion.

Referring particularly to FIG. 3, even when an inside end portion E of the end blade 47 bonded to the carbide tip 50, that is, the inside surface of the end blade 47 opposed to the center side 51 of the rotor along the circumference thereof is worn, it is possible to prevent the carbide tip from being nicked or cracked by rounding an angular portion F of the carbide tip 50.

Figure 12:
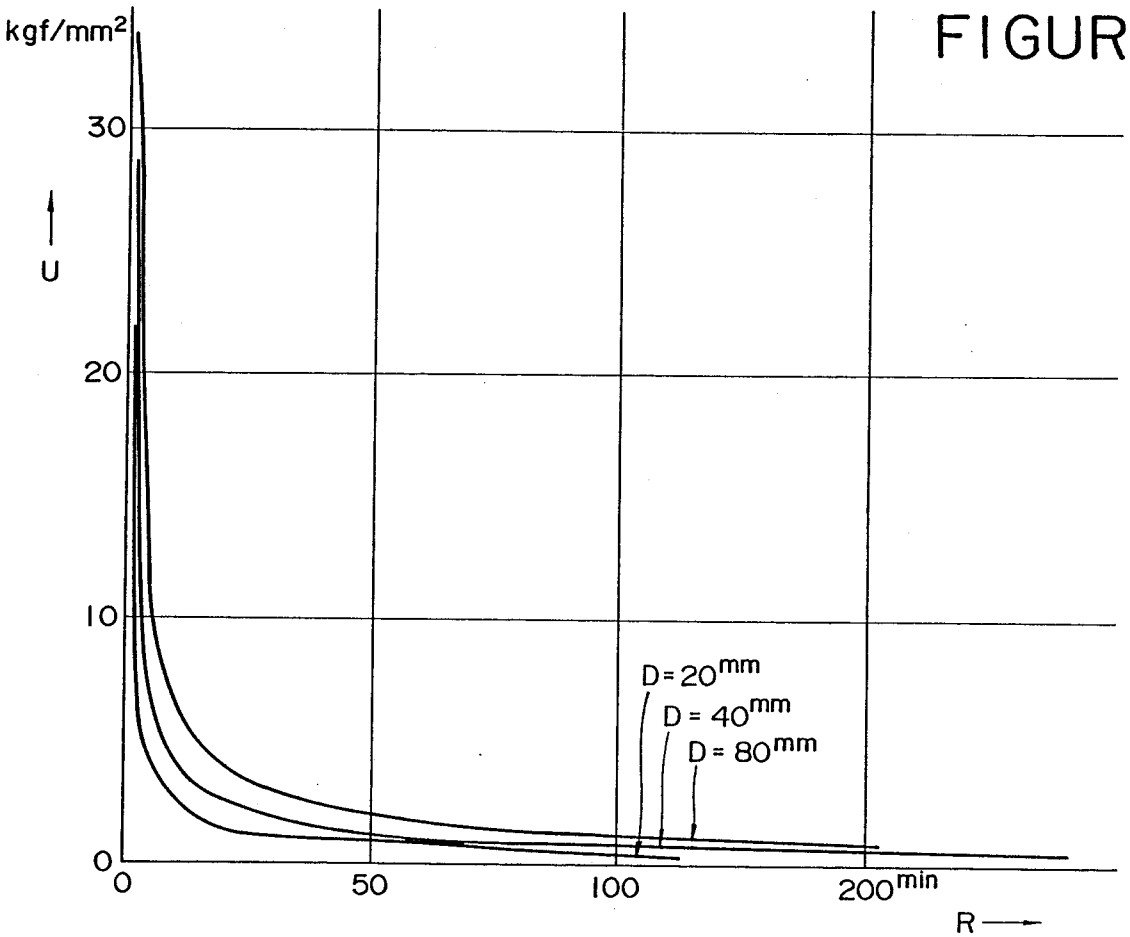
FIG. 12 is a graph showing the relation between a radius of curvature of the angular portion of the carbide tip and a tensile stress generated at the colliding portion shown in FIG. 11.

FIG. 12 shows the relation between the radius of curvature R of the angular portion of the carbide tip and the tensile stress U generated at the colliding portion, wherein the charge stock P is assumed to be spherical as shown in FIG. 11, and the diameter D of the charge stock P is selected to be 20 mm, 40 mm and 80 mm.

As is apparent from FIG. 12, when the radius of curvature R is less than about 1/20 of the diameter D of the charge stock P, the stress concentration is rapidly generated at the colliding portion (angular portion). Therefore, it is possible to reduce nicking or cracking at the angular portion of the carbide tip be setting the radius of curvature R to 1/20 or more of the diameter D of the charge stock P.

As also shown in FIG. 3, the inside and outside portions E and E' of the end blade 47 bonded to the carbide tip 50 are formed with grooves 53 and 53' having an appropriate depth along the bonding line between the carbide tip 50 and the end blade 47. The grooves 53 and 53' are intended to prevent a sharp notch shape by the round chamfered portions formed at the angular portions F and F' of the carbide tip 50 and prevent the concentration of a shearing stress (shown by arrows G and G' in FIG. 3) generated along the bonding line.

That is to say, the concentration of the shearing stress is not generated at or near the bonded portion between the carbide tip 50 and the end blade 47, but is generated at the grooves 53 and 53' and is diffused thereat. Thus, the stress concentration at the bonding portion may be avoided.

Furthermore, an angle formed between the outside surface of the carbide tip 50 on the outer circumferential side 52 of the rotor and the outside surface of the end blade 47 on the outer circumferential or outer radial side 52 is set to be 90 degrees or more, for example. The setting of the angle is intended to avoid the concentration of the shearing stress to be generated at the bonded portion $\gamma$ in the same manner as the above discussion with the grooves 53 and 53'.

FIGS. *5a–5g* show various modifications of the carbide tip and various mounting modes thereof to the end blade.

Referring first to FIG. *5a*, a carbide tip 50' is so mounted as to project inwardly from the inside surface of the end blade 47 opposed to the center side 51 of the rotor. A projecting height H of the carbide tip 50' from the end blade 47 functions similarly to the groove 53 of the previous embodiment. That is, the projecting height is intended to prevent the concentration of the shearing stress to be generated along a bonding line between the carbide tip 50' and the end blade 47. At the same time, the provision of the projecting height is effective for forming a sufficient dead stock.

In addition to the provision of the projecting height H to the carbide tip 50', there are provided grooves 54 and 54' similar to the grooves 53 and 53' of the previous embodiment at or near the bonded portion between the carbide tip 50' and the end blade 47.

With this structure, it is possible to more effectively prevent the concentration of the shearing stress to be generated at the bonded portion between the end blade 47 and the carbide tip 50' by the provision of the projecting height H of the carbide tip 50' from the end blade 47 in cooperation with the groove 54. Further, a second groove 54'' shown by an alternate long and two short dashes line in FIG. *5a* may be formed in the groove 54 as required.

Referring to FIGS. *5b*, *5c* and *5d*, the dimension l of each carbide tip 65 mounted on the end surface of each end blade 47 is identical. Additionally, the end blades 47 of these embodiments are provided with shoulders $S_1$, $S_2$ and $S_3$ having suitable shapes on the center side 51 of the rotor for the purpose of forming a sufficient dead stock even when the particle size of the charge stock is relatively small.

Referring to FIG. *5e*, a large carbide tip 66 is mounted to a large end blade 47. This embodiment is effective in the case that the particle size of the charge stock is large, and the dimension of the carbide tip 66 is required to be increased.

Referring to FIG. *5f*, a carbide tip is divided into a pair of small carbide tips 67 and 68 on the center side 51 and the outer circumference side 52 of the rotor, respectively, with a certain space defined therebetween along the dimension l. With this arrangement, the acceleration effect of the charge stock is not damaged regardless of the decrease in weight of the carbide tip. In particular, when the space between the carbide tips 67 and 68 is $\frac{1}{2}$ or less of the particle size of the charge stock, the dead stock 17 is advantageously formed in the space.

FIG. *5g* shows another embodiment similar to FIG. *5f*, wherein a pair of small carbide tips 67' and 68' are mounted to the end blade 47 with a certain space defined therebetween.

While the invention has been described with reference to specific embodiments, the description is illustrative and is not to be construed as limiting the scope of the invention. Various modifications and changes may occur to those skilled in the art without departing from the spirit and scope of the invention as defined by the appended claims.

What is claimed is:

1. In a crushing apparatus including a sieving machine for selecting a charge stock to be crushed, a rotor adapted to be rotated at high speeds, said rotor being provided with a charge stock discharge opening for discharging outwardly therethrough said charge stock fed into said rotor, by centrifugal force, a collision surface provided around said rotor, wherein said charge stock discharged from said charge stock discharge opening collides with said collision surface and is thereby crushed, and at least one end blade having an outermost surface extending into said charge stock discharge opening; the improvement comprising a carbide tip mounted on a longitudinal outer end portion of said at least one end blade so that said carbide tip extends from said outermost surface of said at least one end blade into said charge stock discharge opening of said rotor, wherein the length of an exposed surface of said carbide tip on a radially interior side of said rotor is $\frac{1}{2}$ or more of a predetermined maximum particle size of said charge stock passing through said sieving machine, and wherein said carbide tip is tapered in such a manner that the thickness of said carbide tip is gradually decreased from the radially interior side of said rotor to an outer circumference side thereof.

2. The crushing apparatus as defined in claim 1, wherein the length dimension of a radially outer surface of said carbide tip on the outer circumference side of said rotor is 3 mm or more.

3. The crushing apparatus as defined in claim 1, wherein said carbide tip is chambered at a predetermined angular portion thereof.

4. The crushing apparatus as defined in claim 1, further comprising a base material bonded to said carbide tip, said base material having a groove formed thereon.

5. The crushing apparatus as defined in claim 4, wherein an angle formed between an outer surface of said carbide tip on the outer circumference side of said rotor and an outer surface of said base material on the outer circumference side of said rotor is 90 degrees or more.

6. In a crushing apparatus including a sieving machine for selecting a charge stock to be crushed, a rotor adapted to be rotated at high speeds, said rotor being provided with a charge stock discharge opening for discharging outwardly therethrough said charge stock fed into said rotor, by centrifugal force, a collision surface provided around said rotor, wherein said charge stock discharged from said charge stock discharge opening collides with said collision surface and is thereby crushed, and at least one end blade having an outermost surface extending into said charge stock discharge opening; the improvement comprising a carbide tip mounted on a longitudinal outer end portion of said at least one end blade so that said carbide tip extends from said outermost surface of said at least one end blade into said charge stock discharge opening of said rotor, wherein the length of an exposed surface of said carbide tip is ½–2 times a predetermined maximum particle size of said charge stock passing through said sieving machine, and wherein said carbide tip is tapered in such a manner that the thickness of said carbide tip is gradually decreased along said length from a radially interior side of said rotor to an outer circumference side thereof.

7. In a crushing method including the steps of:

(a) sieving a charge stock to be crushed to a suitable particle size;

(b) supplying said sieved charge stock to a rotor;

(c) accumulating said sieved charge stock supplied to said rotor near a charge stock discharge opening of said rotor at which is positioned at least one end blade having an outermost surface, (d) discharging outwardly said sieved charge stock from said charge stock discharge opening by a centrifugal force, and (e) bringing said sieved charge stock into collision against a collision surface formed around said rotor thereby crushing said sieved charge stock; wherein the improvement comprises mounting a carbide tip on a longitudinal outer end portion of said at least one end blade so that said carbide tip extends from said outermost surface of said at least one end blade into said charge stock discharge opening of said rotor, and setting a dimension of an exposed surface of said carbide tip on a radially inner side of said rotor to ½ or more of a sieve opening size allowing passage of said charge stock in said sieving step, wherein said carbide tip is tapered in such a manner that the thickness of said carbide tip is gradually decreased from the radially inner side of said rotor to an outer circumference side thereof.

8. The crushing method is defined in claim 7, which further comprises setting a length dimension of said carbide tip to ½–2 times said sieve opening size.

9. A carbide tip for use with a crushing apparatus including a sieving machine for selecting a charge stock to be crushed, a rotor adapted to be rotated at high speeds, said rotor being provided with a charge stock discharge opening for discharging outwardly therethrough said charge stock fed into said rotor, by centrifugal force, a collision surface provided around said rotor, wherein said charge stock discharged from said charge stock discharge opening collides with said collision surface and is thereby crushed, and at least one end blade having an outermost surface extending into said charge stock discharge opening; wherein said carbide tip is mounted on a longitudinal outer end portion of said at least one end blade so that said carbide tip extends from said outermost surface of said at least one end blade and has an exposed surface, and the length of said carbide tip along said exposed surface is ½–2 times a predetermined particle size of said charge stock passing through said sieving machine, and wherein said carbide tip is tapered in such a manner that the thickness of said carbide tip is gradually decreased along said length from a radially inner side of said rotor to an outer circumference side thereof.

10. The carbide tip as defined in claim 9, wherein a width of said carbide tip is 3 mm or more.

* * * * *